US006494183B2

(12) United States Patent
Usui et al.

(10) Patent No.: US 6,494,183 B2
(45) Date of Patent: Dec. 17, 2002

(54) COMMON RAIL FOR DIESEL ENGINE

(75) Inventors: Masayoshi Usui, Numazu (JP); Kikuo Asada, Mishima (JP)

(73) Assignee: Usui Kokusai Sangyo Kaisha Limited (JP)

( * ) Notice: Subject to any disclaimer, the term of this patent is extended or adjusted under 35 U.S.C. 154(b) by 0 days.

(21) Appl. No.: 09/767,466

(22) Filed: Jan. 23, 2001

(65) Prior Publication Data

US 2001/0010216 A1 Aug. 2, 2001

(30) Foreign Application Priority Data

Jan. 26, 2000 (JP) ..... 2000-017526

(51) Int. Cl.[7] ..... F02M 41/00
(52) U.S. Cl. ..... 123/456; 123/468
(58) Field of Search ..... 123/456, 447, 123/468, 469; 138/146, 143; 285/189, 187, 41

(56) References Cited

U.S. PATENT DOCUMENTS 4,028,785 A * 6/1977 Jackson et al. ..... 29/157.3 R
4,832,376 A 5/1989 Sugao
4,893,601 A 1/1990 Sugao
4,900,180 A 2/1990 Takikawa
5,072,710 A * 12/1991 Washizu ..... 123/470
5,120,084 A 6/1992 Hashimoto
5,143,410 A 9/1992 Takikawa
5,169,182 A 12/1992 Hashimoto
5,172,939 A 12/1992 Hashimoto
5,482,090 A * 1/1996 Yamanashi ..... 138/143
5,667,255 A 9/1997 Kato
5,887,910 A 3/1999 Usui
5,957,507 A 9/1999 Asada
5,979,945 A 11/1999 Hitachi et al.
5,992,904 A 11/1999 Hitachi et al.
6,045,162 A * 4/2000 Haibara ..... 285/55
6,050,611 A 4/2000 Asada
6,126,208 A 10/2000 Asada et al.

FOREIGN PATENT DOCUMENTS

JP 2-802289 6/1990
JP 3-177693 8/1991
JP 4-175462 6/1992

* cited by examiner

*Primary Examiner*—Willis R. Wolfe
*Assistant Examiner*—Mahmoud Gimie
(74) *Attorney, Agent, or Firm*—Anthony J. Casella; Gerald E. Hespos

(57) ABSTRACT

A common rail includes a main pipe rail having a circulating passage extending in its inside in the axial direction thereof, branch holes formed in an axial peripheral wall portion of the main pipe rail, and branch connectors connected to the respective branch holes integrally or via separate connecting members. A Ni-diffused fatigue strength reinforcing layer is formed by heating a Ni layer plated in advance on at least a portion of an inner circumferential surface of the common rail. The increased strength and the action of the fatigue strength reinforcing layer lowers the degree of fatigue concentration to increase fatigue strength against inner pressure.

9 Claims, 9 Drawing Sheets

COMMON RAIL FOR DIESEL ENGINE

BACKGROUND OF THE INVENTION

1. Field of the Invention

The present invention generally relates to a common rail such as a high-pressure fuel branch pipe or a block rail in an accumulated-pressure fuel injection system for a diesel internal combustion engine.

2. Description of the Prior Arts

A number of constructions have heretofore been known in the field of this kind of diesel engine fuel injection pipe. In the construction shown in FIG. 6 by way of example, a main pipe rail 1 has a circulating passage 1-1 of circular cross section formed in a peripheral portion of the interior of the main pipe rail 1 as well as a branch hole 1-2 which communicates with the circulating passage 1-1, and the branch hole 1-2 is outwardly opened to form a pressure-receiving seat surface 1-3. A ring-shaped connecting fitting 3 is used to surround the outer circumferential portion of the main pipe rail 1 in the vicinity of the pressure-receiving seat surface 1-3. A branch pipe 2 which serves as a branch connector has a connecting head 2-2 at one end, and the connecting head 2-2 is formed into, for example, a tapered conical enlarged-diameter shape by buckling. A pressure-applying seat surface 2-3 formed by the connecting head 2-2 is brought into engagement with the pressure-receiving seat surface 1-3, and a nut 4 which is fitted on the branch pipe 2 by a sleeve washer 5 in advance is screwed into a threaded wall portion 3-1 which is formed in the connecting fitting 3 in such a manner as to project radially outwardly from the main pipe rail 1. The branch pipe 2 is connected to the main pipe rail 1 in the state of being fastened by the pressure applied to the neck of the connecting head 2-2 due to the screwing of the nut 4 into the threaded wall portion 3-1. In the known construction shown in FIG. 7 or 8, instead of the ring-shaped connecting fitting 3, a pipe-shaped sleeve nipple 3*a* or 3*b* is directly fitted to the outer peripheral wall of the main pipe rail 1 by a method of screwing a projecting portion into a recessed portion or by welding so that the pipe-shaped sleeve nipple 3*a* or 3*b* projects radially outwardly from the main pipe rail 1. The pressure-applying seat surface 2-3 formed by the connecting head 2-2 of the branch pipe 2 is brought into engagement with the pressure-receiving seat surface 1-3 of the main pipe rail 1, and a nut 4 which is screwed into the pipe-shaped sleeve nipple 3*a* or 3*b* is fastened to connect the branch pipe 2 to the main pipe rail 1. In the known construction shown in FIG. 9, a boss 3*c* is formed integrally with the main pipe rail 1 of a common rail, and the pressure-applying seat surface 2-3 formed by the connecting head 2-2 of the branch pipe 2 is brought into engagement with the pressure-receiving seat surface 1-3 of the main pipe rail 1. A box nut 6 which is screwed on a threaded portion 3-2 provided around the outer circumferential surface of the boss 3*c* is fastened to connect the branch pipe 2 to the main pipe rail 1. A block rail type common rail (not shown) is also known.

However, in any of the prior art common rails, a large stress occurs in an inner circumferential edge portion P of the lower end of the branch hole 1-2 owing to the inner pressure of the main pipe rail 1 and an axial force applied to the pressure-receiving seat surface 1-3 by the pressure of the connecting head 2-2 of the branch pipe 2 which serves as a branch connector. Cracks easily occur from the lower-end inner circumferential edge portion P, and there is a possibility that the cracks causes leakage of fuel. In addition, a nonmetal inclusion contained in a parent metal may be exposed on a surface by cutting. This nonmetal inclusion is mainly made of an oxide such as $Al_2O_3$ or CaO, and is extremely high in hardness and extremely small in elongation compared to the parent metal and is, in addition, weak in bonding force to the parent metal. If such a nonmetal inclusion exists in the inner circumferential edge portion P of the lower end of the branch hole 1-2, stress concentration occurs as in the above-described case and causes a fatigue failure, so that the fatigue strength of the main pipe rain 1 is lowered. in addition, if the nonmetal inclusion exists in a surface portion immediately below the surface of the parent metal, the lowering of the fatigue strength. is similarly Incurred. The lowering of the fatigue strength due to the nonmetal inclusion is considered to be caused by an increase in stress concentration due to the difference in hardness or elongation between the parent metal and the nonmetal inclusion.

SUMMER OF THE INVENTION

The invention has been made to solve the above-described problems of the prior art, and provides a common rail for a diesel engine in which fatigue strength against inner pressure can be increased by lowering the extent of concentration of stress which occurs in the portions of intersections of branch holes which include the inner peripheral edges of the lower ends of the respective branch holes 1-2 and a circulating passage of the main pipe rail, or in the branch holes, the inner circumferential surface of the main pipe rail or the like.

The common rail for a diesel engine according to the invention includes a main pipe rail having a circulating passage extending in its inside in the axial direction thereof, branch holes formed in a peripheral wall portion of the main pipe rail, and branch connectors connected to the respective branch holes integrally or via separate connecting members, and a Ni-diffused fatigue strength reinforcing layer which is formed by heating a Ni layer prepared in advance by plating of pure Ni or a Ni-base alloy such as Ni—P is formed in at least a portion of an inner circumferential surface of the common rail.

In addition, portions in which to form the Ni-diffused fatigue strength reinforcing layer which is formed by heating the Ni layer plated in advance may be the branch holes and the portions of intersections of the branch holes and the circulating passage of the main pipe rail, or the circulating passage of the main pipe rail, or the entire circumferential surface of the common rail.

In the common rail for a diesel engine, in the case where the Ni-diffused fatigue strength reinforcing layer which is formed by heating the Ni layer plated in advance is formed in the portion of the surface or a surface portion of a parent metal where a nonmetal inclusion is present, the fatigue strength reinforcing layer formed by heating this Ni layer is larger in hardness and smaller in elongation than the parent metal, whereby the difference in hardness or elongation between a steel surface and the nonmetal inclusion in the surface or the surface layer of the parent metal becomes small. In the case where this fatigue strength reinforcing layer is formed in, for example, the portions of intersections of the branch holes and the circulating passage of the main pipe rail, the degree of concentration of fatigue stress which occurs in the portions of intersections of the branch holes and the circulating passage of the main pipe rail is lowered and the maximum value of stress which occurs in the intersection portions is lowered, whereby fatigue strength against inner pressure is improved. Incidentally, the thickness of the fatigue strength reinforcing layer is not limited to a particular value, but 10–30 μm is appropriate for the fatigue strength reinforcing layer to serve its effect and advantage.

Incidentally, each of the portions of intersections of the branch holes and the circulating passage of the main pipe rail over which the Ni-diffused fatigue strength reinforcing layer is formed may be chamfered in an arcuate shape to form an R-chamfered portion made of a curved surface having no edge The cross-sectional shape of this R-chamfered portion may be a shape in which a tapered surface is joined to the inner circumferential surface of the branch hole via a smooth curved surface and the inner circumferential surface of the circulating passage of the main pipe rail is joined the tapered surface via the smooth curved surface, or the shape of a spherical surface, an ellipsoidal surface of revolution a paraboloid of revolution or a hyperboloid revolution.

BRIEF DESCRIPTION OF THE DRAWINGS

The invention will become more readily appreciated and understood from the following detailed description of a preferred embodiment of the invention when taken in conjunction with the accompanying drawings, in which.

DETAILED DESCRIPTION OF PREFERRED EMBODIMENTS

Figure 1:
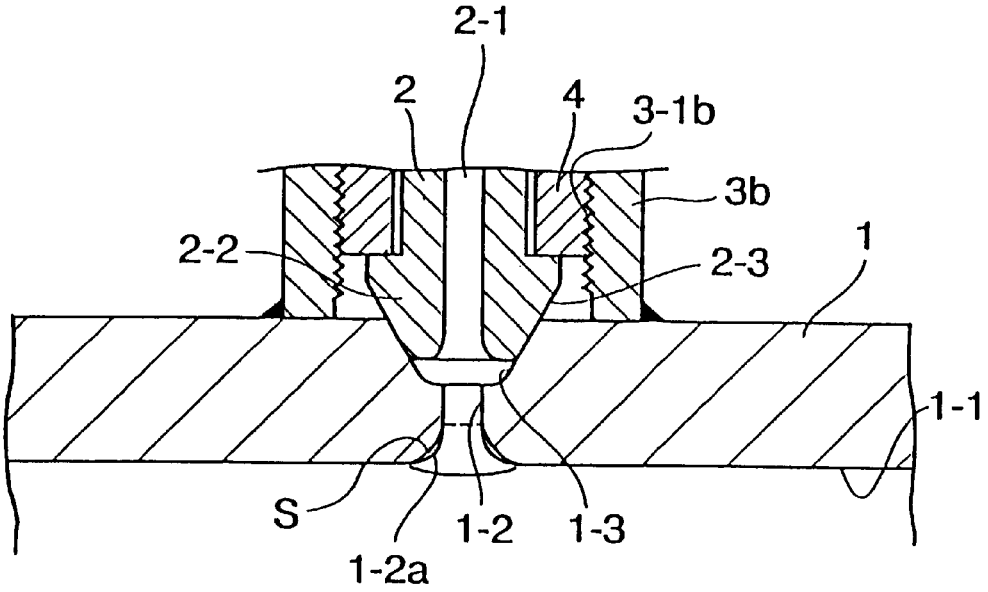
FIG. 1 is a partially cutaway, enlarged cross-sectional view of a main pipe rail, showing one embodiment of a common rail for a diesel engine according to the invention.
Figure 6:
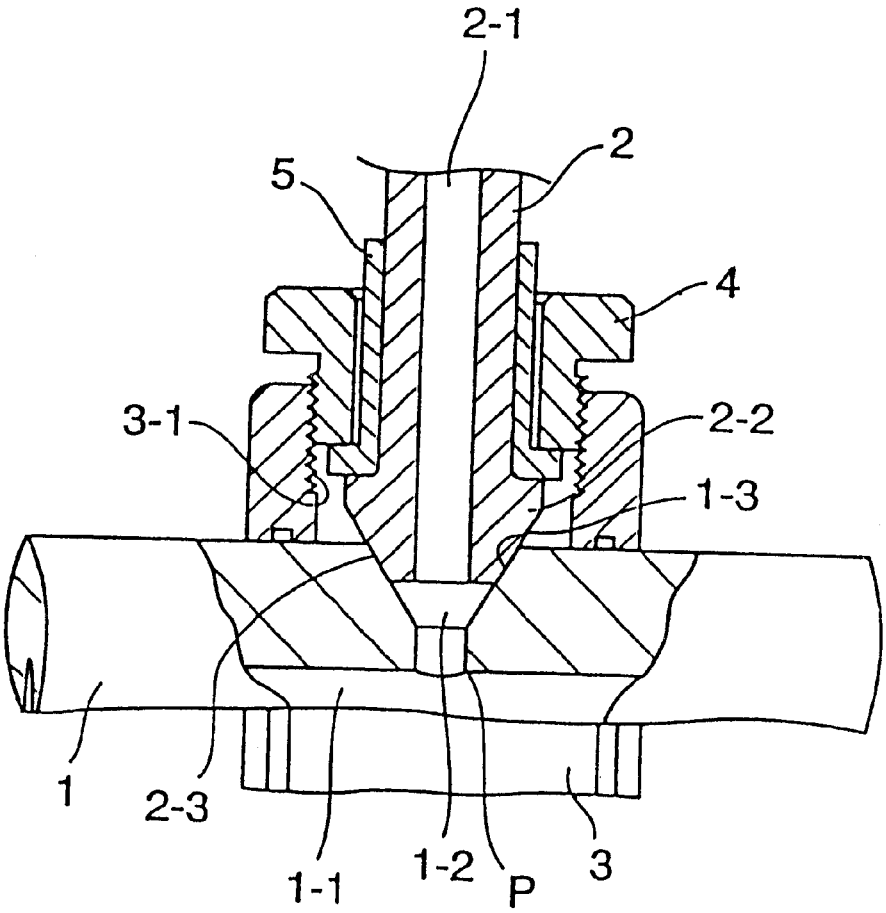
Fig. 6 PRIOR ART
FIG. 6 is a partially cutaway, enlarged cross-sectional view of one example of a prior art common rail which uses a ring-shaped connecting fitting.

The diesel-engine common rail shown in FIG. 1 according to the invention has a construction similar to that of the common rail shown in FIG. 6. A nut 4 is incorporated in advance in a branch pipe 2 which serves as a branch connector, and a pipe-shaped sleeve nipple 3*b* which serves as a connecting portion has a threaded surface 3-1*b* formed around its inner circumferential surface. The proximal end of the sleeve nipple 3*b* is welded to the outer circumferential wall of the main pipe rail 1 in the vicinity of the pressure-receiving seat surface 1-3 concentrically to the branch hole 1-2 in such a manner that the sleeve nipple 3*b* surrounds the pressure-receiving seat surface 1-3. A pressure-applying seat surface 2-3 formed by a connecting head 2-2 of the branch pipe 2 is brought into engagement with the pressure-receiving seat surf ace 1-3 of a main pipe rail 1, and the nut 4 which is screwed on the sleeve nipple 3*b* is fastened to connect the branch pipe 2 to the main pipe rail 1. in this construction, the branch hole 1-2 which communicates with a circulating passage 1-1 of circular cross section of the main pipe rail 1 has an opening to the circulating passage 1-1, and the end of the opening is chamfered in an arcuate shape to form an R-chamfered portion 1-2*a* made of a curved surface having no edge. A Ni-diffused fatigue strength reinforcing layer S formed by heating a Ni layer plated in advance is formed over the intersection portion formed of the R-chamfered portion 1-2*a*.

The main pipe rail 1 which serves as the common rail is made of a comparatively thick-walled and small-diameter metal pipe which is, for example, approximately 24 mm in pipe diameter and approximately 8 mm in wall thickness, and the axial interior or the main pipe rail 1 is formed into the circulating passage 1-1 of circular cross section. Plural branch holes 1-2 are formed in the main pipe rail 1 in such a manner that the respective branch holes 1-2, correspond to plural pressure-receiving seat surfaces 1-3 which are axially spaced apart from one another along the circulating passage 1-1 and are outwardly opened in the peripheral wall portion of the main pipe rail 1, and in such a manner that the branch holes 1-2 communicate with the circulating passage 1-1. Each of the branch connectors is made of the branch pipe 2 or a branch fitting of the above-described type, and has in its interior a flow passage 2-1 which leads to the circulating passage 1-1. Each of the branch connectors also has at one end the connecting head 2-2 which is formed in a tapered conical enlarged-diameter shape by buckling and forms the pressure-applying seat surface 2-3.

Figure 2:
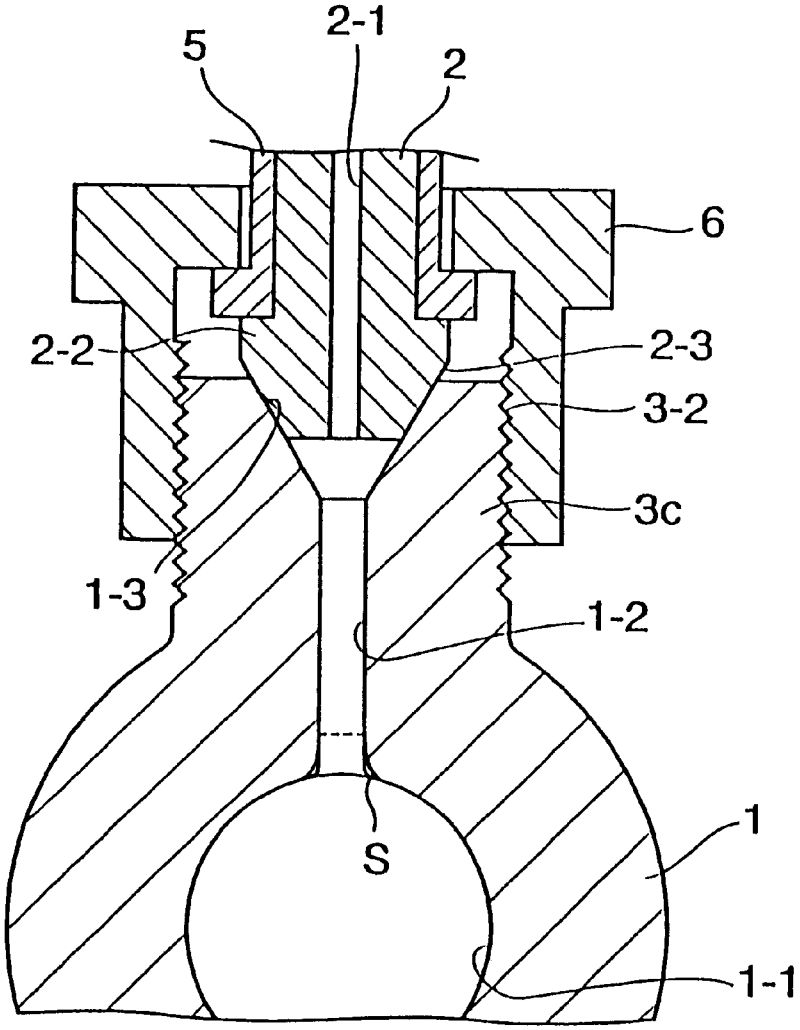
FIG. 2 is a view similar to FIG. 1, showing another embodiment of a common rail for a diesel engine according to the invention.
Figure 7:
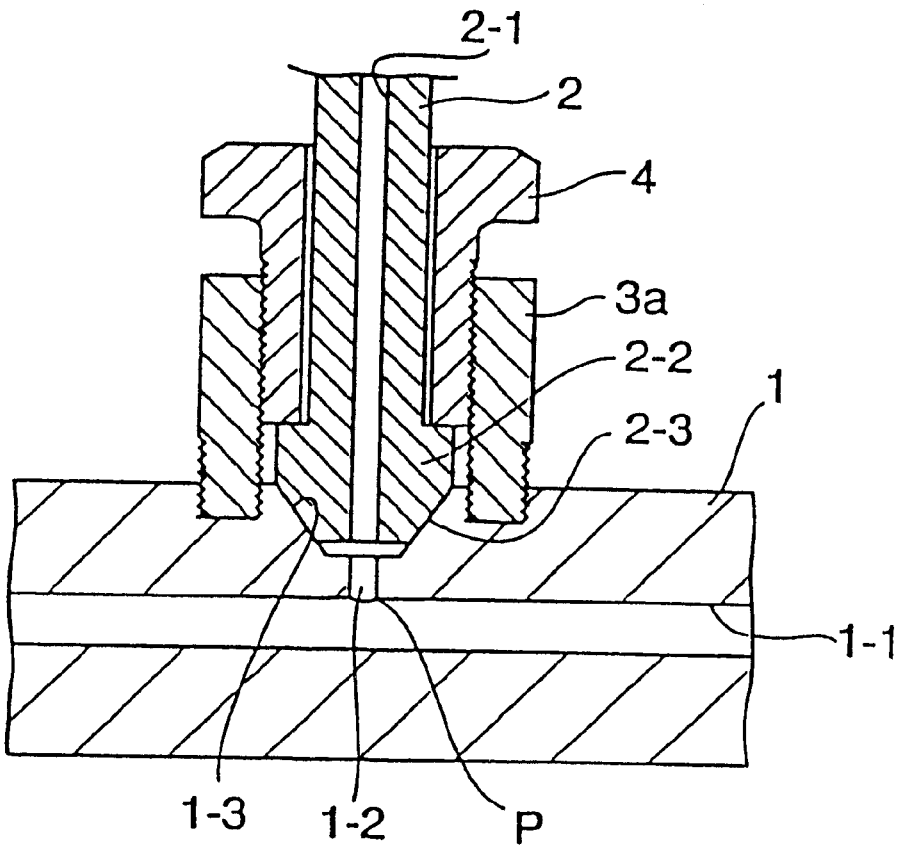
Fig. 7 PRIOR ART
FIG. 7 is a partially cutaway cross-sectional view of one example of a prior art common rail having a construction in which a pipe-shaped sleeve nipple is fitted to a main pipe rail by a method of screwing a projecting portion into a recessed portion.
Figure 8:
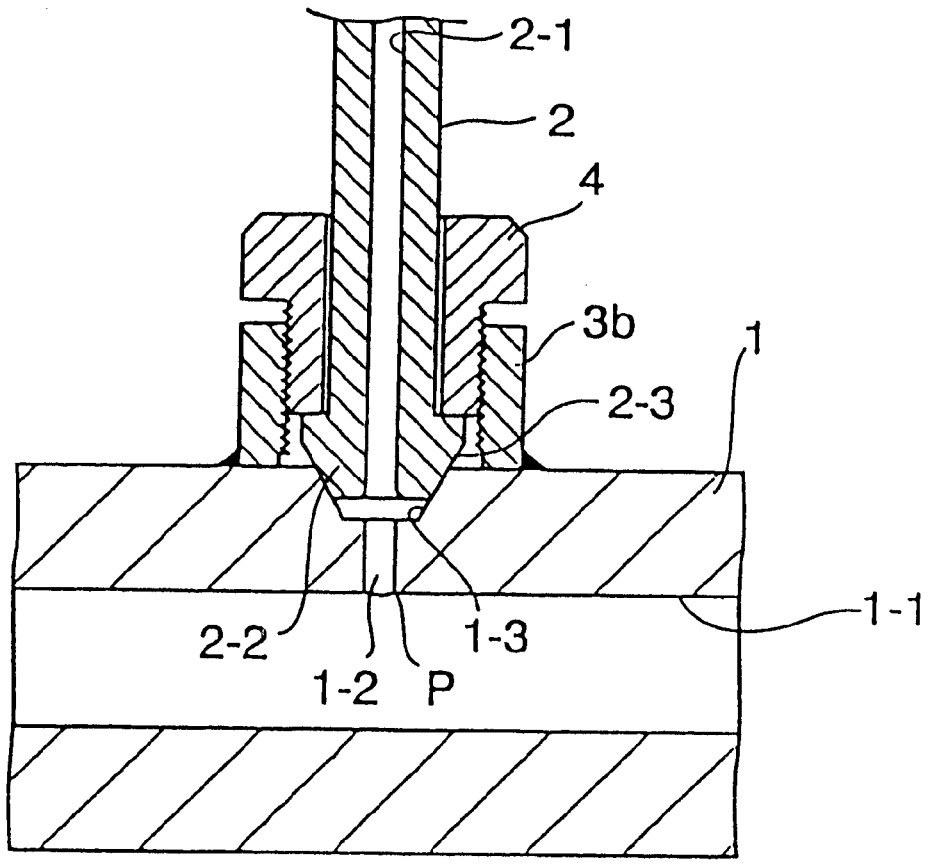
Fig. 8 PRIOR ART
FIG. 8 is a partially cutaway cross-sectional view of one example of a prior art common rail having a construction in which a pipe-shaped sleeve nipple is fitted to a main pipe rail by welding.
Figure 9:
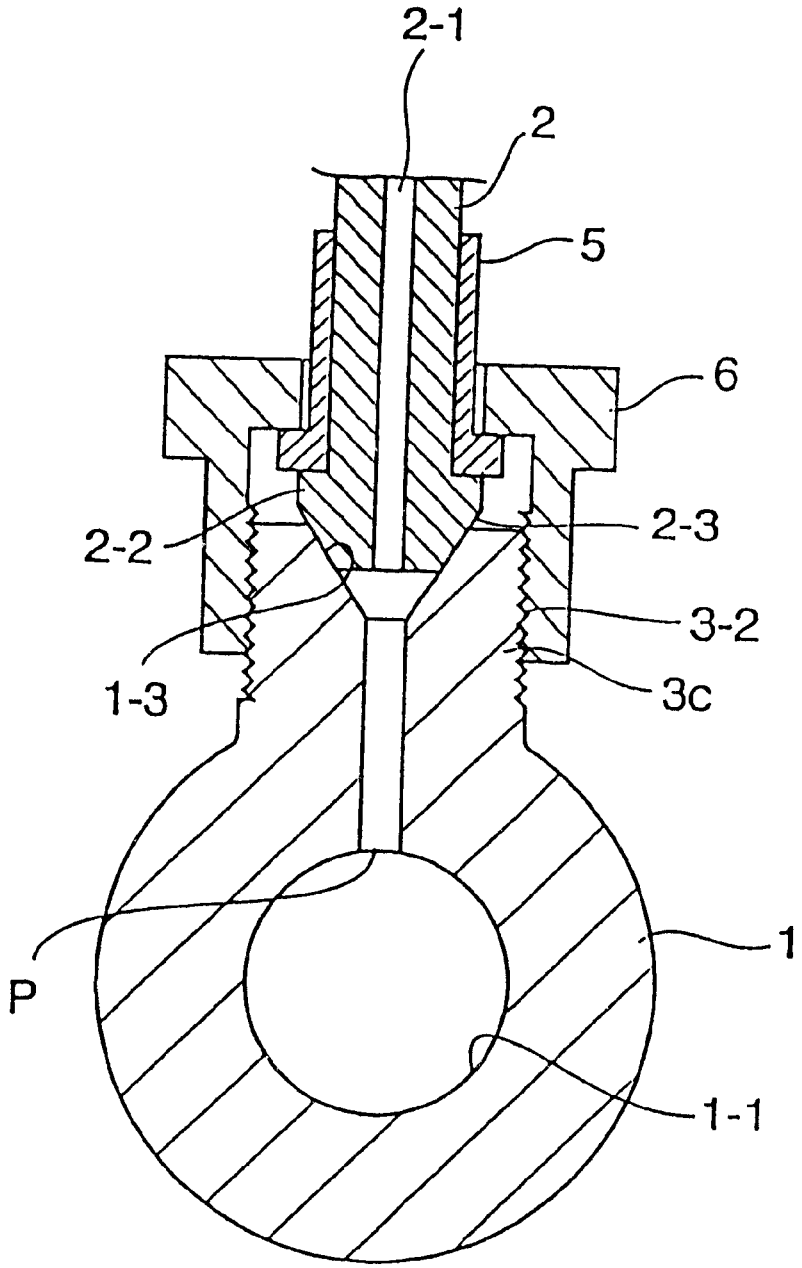
Fig. 9 PRIOR ART
FIG. 9 is a cross-sectional view showing one example of a prior art common rail on which a projecting boss is integrally formed.

The diesel-engine common rail shown in FIG. 2 has a construction similar to that of the common rail shown in FIG. 7. A boss 3*c* is formed integrally with the main pipe rail 1, and the pressure-applying seat surface 2-3 formed by the connecting head 2-2 of the branch pipe 2 is brought into engagement with the pressure-receiving seat surface 1-3 of the main pipe rail 1. A box nut 6 which is screwed on a threaded portion 3-2 provided around the outer circumferential surface of the boss 3*c* is fastened to connect the branch pipe 2 to the main pipe rail 1. In this construction, the portion of intersection of the circulating passage 1-1 of. circular cross section in the main pipe rail 1 and the branch hole 1-2 which communicates with the 1-main pipe rail 1 is plated with a Ni-diffused fatigue strength reinforcing layer S formed by heating a Ni layer plated on the intersection portion in advance.

Figure 3:
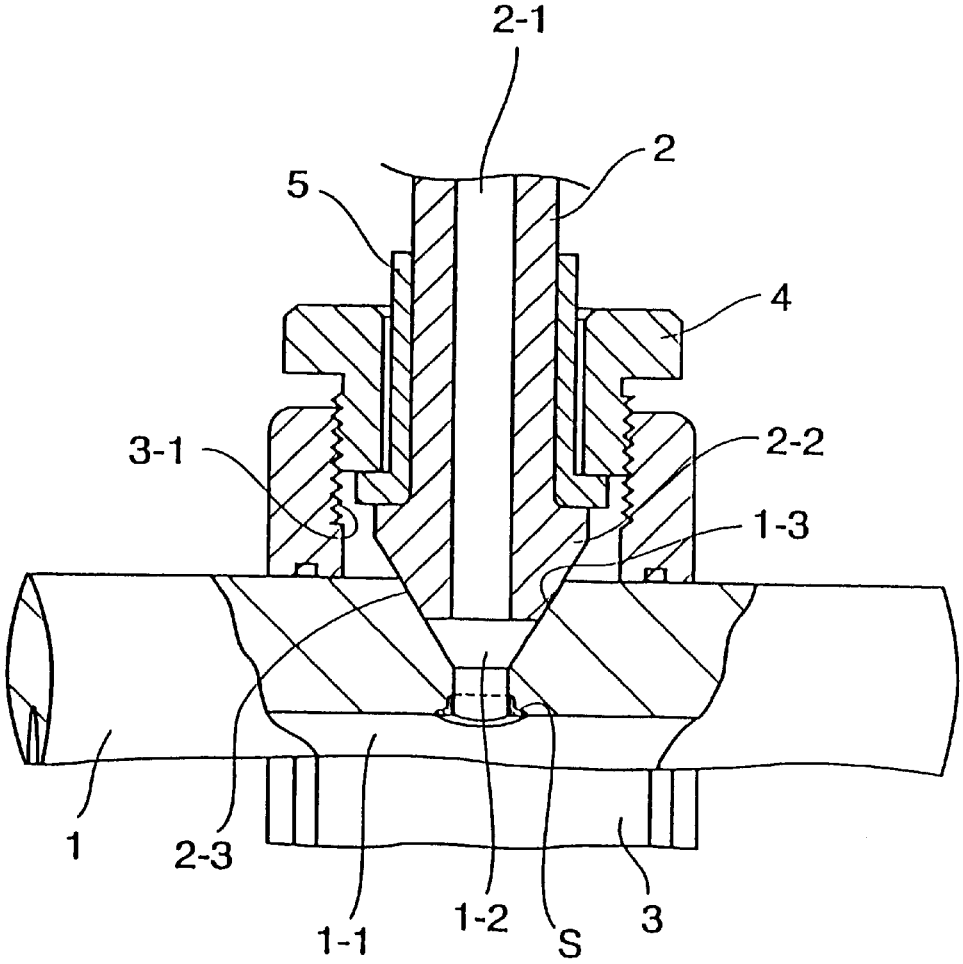
FIG. 3 is a view similar to FIG. 1, showing yet another embodiment of a common rail for a diesel engine according to the invention.

The diesel-engine common rail shown in FIG. 3 has a construction similar to that of the common rail shown in FIG. 6. The branch hole 1-2 formed in the peripheral wall portion of the main pipe rail 1 is outwardly opened to form the pressure-receiving seat surface 1-3, and the ring-shaped connecting fitting 3 is used to surround the outer circumferential portion of the main pipe rail 1 in the vicinity of the pressure-receiving seat surface 1-3. The pressure-applying seat surface 2-3 which is formed by the connecting head 2-2 formed at the end of the branch pipe 2 is brought into engagement with the pressure-receiving seat surface 1-3, and the branch pipe 2 is connected to the main pipe rail 1 in the state of being fastened by the pressure applied to the neck of the connecting head 2-2 due to the screwing of the nut 4 into the threaded wall portion 3-1. The threaded wall portion 3-1 is formed in the connecting fitting 3 in such a manner as to project radially outwardly from the main pipe rail 1, and the nut 4 is fitted on the branch pipe 2 by the sleeve washer 5 in advance. In this construction, a Ni-diffused fatigue strength reinforcing layer S formed by heating a Ni layer plated in advance is formed over the portion of intersection of the circulating passage 1-1 of circular cross section in the main pipe rail 1 and the branch hole 1-2.

Figure 4:
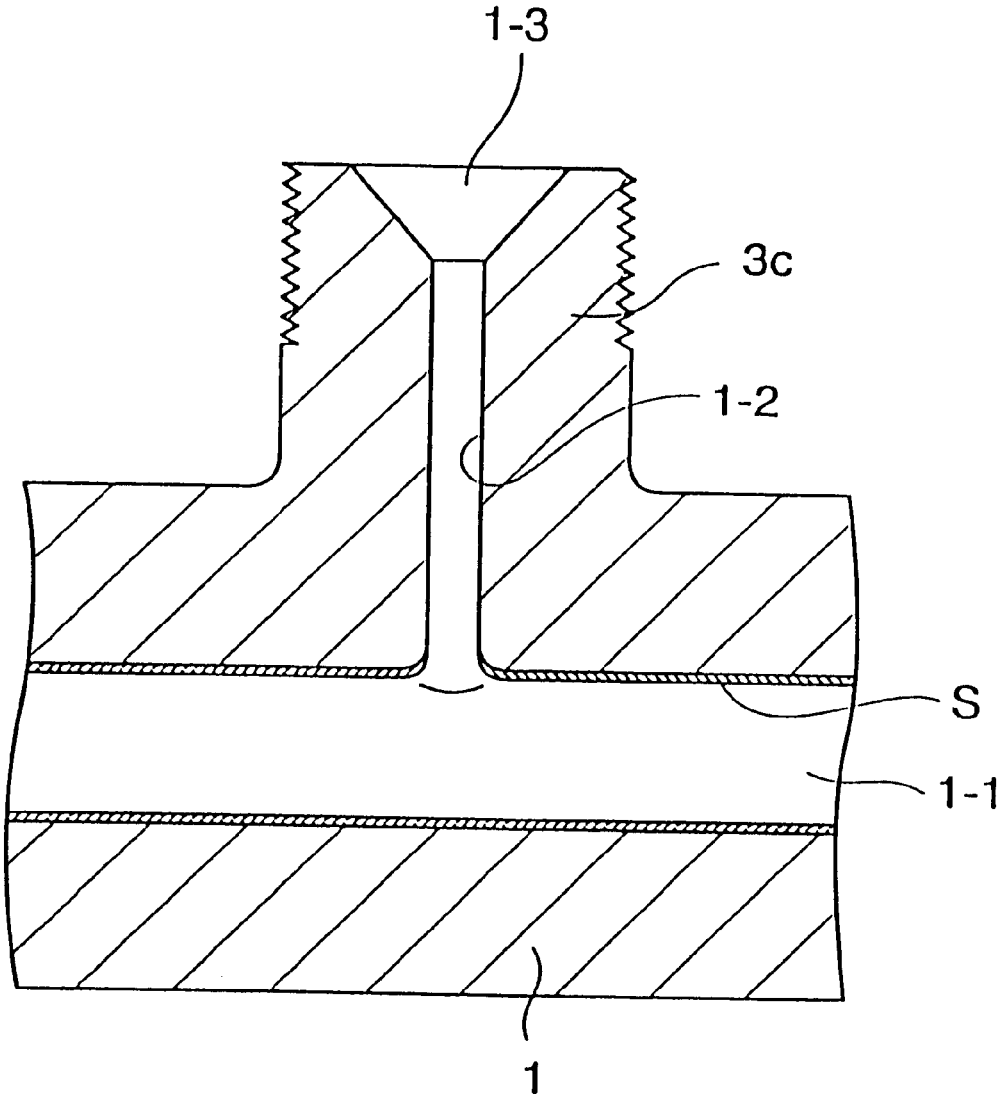
FIG. 4 is an enlarged cross-sectional view of a main pipe, showing a fourth embodiment of the invention.

Referring to the diesel-engine common rail shown in FIG. 4, in the main pipe rail 1 similar to that shown in FIG. 2, a Ni-diffused fatigue strength reinforcing layer S formed by heating a Ni layer plated in advance is formed over the portion of intersection of the branch hole 1-2 and the circulating passage 1-1 in the main pipe rail 1, and over the entire inner surface of the circulating passage 1-1.

Figure 5:
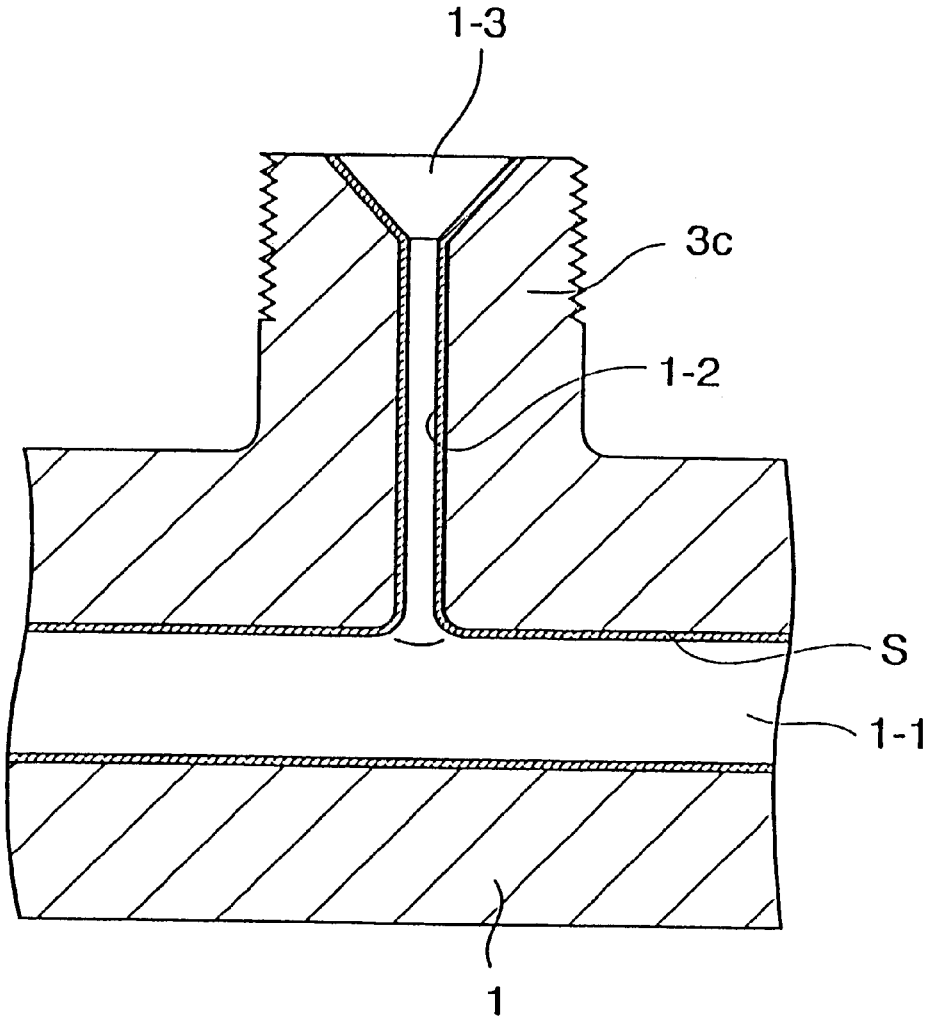
FIG. 5 is a view similar to FIG. 4, showing a fifth embodiment of the invention.

Referring to the diesel-engine common rail shown in FIG. 5, in the main pipe rail 1 similar to that shown in FIG. 4, a Ni-diffused fatigue strength reinforcing layer S formed by heating a Ni layer plated in advance is formed over the branch hole 1-2 and the pressure-receiving seat surface 1-3 of the main pipe rail, the portion of intersection of the branch hole 1-2 and the circulating passage 1-1, and the entire inner surface of the circulating passage 1-1.

In the case where the Ni-diffused fatigue strength reinforcing layer S is formed in the above-described manner on the portion of intersection of the branch hole 1-2 which communicates with the circulating passage 1-1 of the main pipe rail 1 and the circulating passage 1-1 of the main pipe rail 1, or over the portion of intersection and the circulating passage 1-1 of the main pipe rail 11 or over the entire inner circumferential surface of the main pipe rail 1, the portion of intersection of the branch hole 1-2 and the circulating passage 1-1 or the portion of intersection and the circulating passage 1-1 of the main pipe rail 1 or the entire inner circumferential surface of the main pipe rail 1 increases in strength against inner pressure working on the main pipe rail 1, and the degree of stress concentration due to the nonmetal inclusion is reduced to a great extent. Accordingly, it is possible to substantially solve the problem that cracks occur from the portion of intersection of the branch hole 1-2 and the circulating passage 1-1, such as the opening edge portion P.

As described above, in accordance with the invention, in a common rail for a diesel engine which includes branch holes formed in an axial peripheral wall portion of a main pipe rail and branch connectors connected to the respective branch holes integrally or via separate connecting members, a. Ni-diffused fatigue strength reinforcing layer which is formed by heating a Ni layer plated in advance is formed in at least a portion of the inner circumferential surface of the common rail, such as the branch holes or the portions of intersections of the branch holes and a circulating passage of the main pipe rail. Accordingly, the increased strength and the action of the fatigue strength reinforcing layer make small the difference in hardness or elongation between a steel surface and a nonmetal inclusion occurring in the inner surface or the surface layer of a rail. thereby lowering the degree of fatigue concentration to increase fatigue strength against inner pressure. Consequently, the common rail for a diesel engine serves the superior advantage of being capable of performing reliable and stable functions with superior durability and without leakage of fuel due to occurrence of cracks.

EXAMPLES

A 4-$\mu$m-thick Ni plating layer was formed by electroplating over the portions of intersections of branch holes and a circulating passage of an S45C-made common rail formed by continuous forging (its main pipe rail was 24 mmØ in outer diameter, 10 mmØ in inner diameter and 3 mmØ in branch-hole diameter). The common rail was placed in an inert gas atmosphere heating furnace, and was heating at 1,130° C. for 3 minutes and then quenched to form a Ni-diffused fatigue strength reinforcing layer of thickness about 18 $\mu$m over the surface portion of the portions of intersections of the branch holes and the circulating passage.

When the fatigue limit of the common rail was examined with a repeated pressure testing machine, the following result was obtained. A comparative related art common rail of the same size which had no fatigue strength reinforcing layer over the portions of intersections of branch holes and a circulating passage was damaged by the 800,000-times application of a hydraulic pressure of 180–1,500 Bar in a repeated test. In contrast, the common rail according to the invention showed the high durability of being not damaged even by the 10,000,000-times application of a hydraulic pressure of 180–1,900 Bar in a repeated test. It can be inferred that this result was obtained from an increase in strength due to the Ni-diffused fatigue strength reinforcing layer of thickness about 18 $\mu$m formed over the portions of intersections of the branch holes and the circulating passage of the main pipe rail as well as owing to the fact that the degree of stress concentration due to a nonmetal inclusion was lowered.

Incidentally, from the observation of a cut surface of the comparative material, it has been confirmed that a nonmetal inclusion was present in a portion from which a fatigue failure occurred. In addition, it goes without saying that even if the Ni layer is made of a Ni-base alloy, similar effects and advantages can be achieved.

What is claimed is:

1. A common rail for a diesel engine comprising:

a main pipe rail having an axial peripheral wall and a circulating passage extending inside the axial peripheral wall in the axial direction thereof and defining an inner circumferential surface;

branch holes formed through the axial peripheral wall of the main pipe rail; and branch connectors connected to the main pipe rail at the respective branch holes, a Ni-diffused fatigue strength reinforcing layer formed by plating a Ni layer on at least a portion of the inner circumferential surface of the main pipe rail and heating the main pipe rail sufficiently so that the Ni plated layer is diffused into the axial peripheral wall, thereby reducing a difference in hardness and elongation properties between non-metal inclusions and steel surfaces in portions of the axial peripheral wall adjacent the inner circumferential surface.

2. A common rail for a diesel engine according to claim 1, wherein the Ni-diffused fatigue strength reinforcing layer which is formed by heating the Ni layer plated in advance is formed over portions of intersections of the branch holes and the circulating passage of the main pipe rail.

3. A common rail for a diesel engine according to claim 1, wherein the Ni-diffused fatigue strength reinforcing layer which is formed by heating the Ni layer plated in advance is formed over the entire inner circumferential surface of the common rail.

4. A common rail for a diesel engine according to claim 1, wherein the Ni-diffused fatigue strength reinforcing-layer which is formed by heating the Ni layer plated in advance is formed in the circulating passage of the main pipe rail.

5. A common rail for a diesel engine according to claim 1, wherein the Ni-diffused fatigue strength reinforcing layer extends into the inner circumferential surface a distance of 10–30 $\mu$m.

6. A common rail for a diesel engine according to claim 5, wherein the axial peripheral wall has a thickness sufficient to accommodate hydraulic pressure of at least approximately 1,500 bar.

7. A common rail for a diesel engine according to claim 6, wherein the main pipe rail is formed from a steel material.

8. A common rail for a diesel engine according to claim 7, wherein the Ni-diffused fatigue strength reinforcing layer extends into the inner circumferential surface a distance of approximately 18 $\mu$m.

9. A common rail for a diesel engine according to claim 1, wherein the Ni layer is plated in advance to a thickness of about 4 $\mu$m and is heated sufficiently for said Ni layer to the diffuse to a thickness of 10–30 $\mu$m in the main pipe rail from the inner circumferential.

* * * * *